US005297789A

United States Patent [19]

Filsinger et al.

[11] Patent Number: 5,297,789

[45] Date of Patent: Mar. 29, 1994

[54] DEVICE FOR ALIGNING A LEADING EDGE OF A SHEET

[75] Inventors: Karl-Heinz Filsinger, Wiesloch; Michael Gieser, Oftersheim, both of Fed. Rep. of Germany

[73] Assignee: Heidelberger Druckmaschinen AG, Heidelberg, Fed. Rep. of Germany

[21] Appl. No.: 964,938

[22] Filed: Oct. 22, 1992

[30] Foreign Application Priority Data

Oct. 22, 1991 [DE] Fed. Rep. of Germany ..... 4134767

[51] Int. Cl.[5] ..... B65H 9/04

[52] U.S. Cl. ..... 271/245; 271/253

[58] Field of Search ..... 271/244–247, 271/253–255

[56] References Cited

U.S. PATENT DOCUMENTS

| | | | |
|---|---|---|---|
| 1,167,653 | 1/1916 | Nielsen | 271/253 |
| 2,643,881 | 6/1953 | Albrecht . | |
| 2,685,446 | 8/1954 | Backhouse | 271/253 |
| 3,006,637 | 10/1961 | Backhouse . | |
| 5,033,732 | 7/1991 | Pollich | 271/245 |

FOREIGN PATENT DOCUMENTS

| | | | |
|---|---|---|---|
| 847288 | 8/1952 | Fed. Rep. of Germany | 271/245 |
| 2743557 | 3/1979 | Fed. Rep. of Germany . | |
| 4004447 | 9/1990 | Fed. Rep. of Germany . | |
| 1340364 | 9/1962 | France . | |
| 29791 | 12/1912 | United Kingdom | 271/246 |
| 657638 | 9/1951 | United Kingdom | 271/253 |
| 722063 | 1/1955 | United Kingdom . | |

*Primary Examiner*—David H. Bollinger

*Attorney, Agent, or Firm*—Herbert L. Lerner; Laurence A. Greenberg

[57] ABSTRACT

Device for aligning a leading edge of sheets includes a plurality of front lays cyclically movable into an operating position. Also included are an aligned engagement member engageable by the plurality of front lays, and a force-storage device for bringing the plurality of front lays into engagement with the engagement member in the operating position of the plurality of front lays. A device, which is independent of the engagement member ,is also provided for diabling individual front lays of the plurality of front lays from engagement with the aligned engagement member.

12 Claims, 8 Drawing Sheets

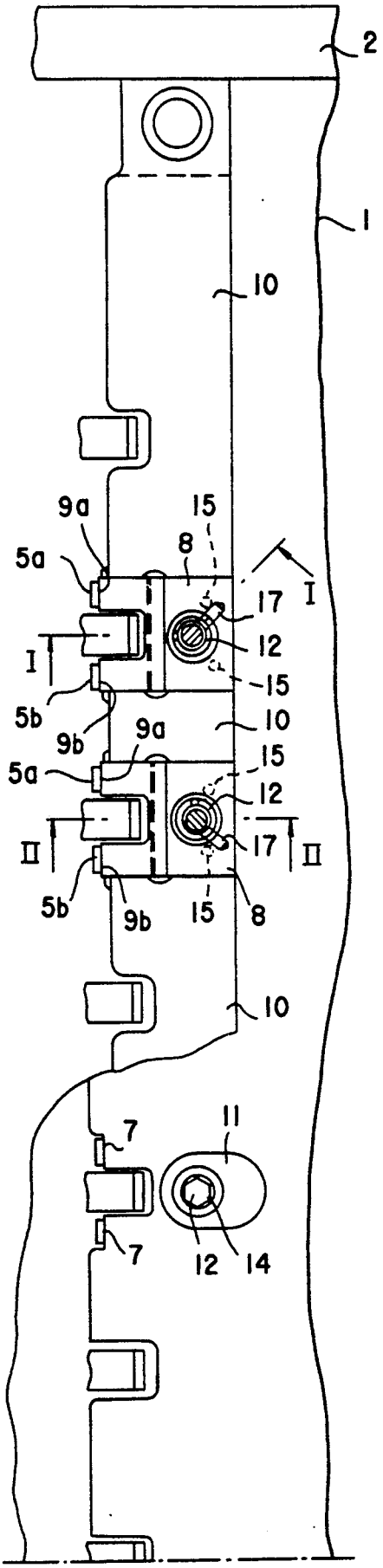
Fig.2
Fig.2a
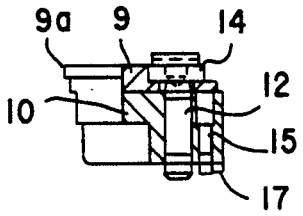
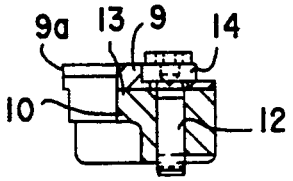
Fig.2b

DEVICE FOR ALIGNING A LEADING EDGE OF A SHEET

The invention relates to a device for aligning a leading edge of a paper sheet, for example, having front lays which are moved cyclically into an operating position.

German Patent 27 43 557 discloses a front-lay device wherein front-lay holders are fastened with the aid of a clamping member onto a front-lay shaft by which a swiveling movement of the front lays is introduced into the operating cycle. A carrier of a front lay is swingably mounted on each front-lay holder. An adjustment of the position of a front lay may be effected by a positioning mechanism which acts upon the carrier, and by a compression spring which acts between the carrier and the respective front-lay holder. For this purpose, the carriers with the front lays should be swiveled by the positioning mechanism or means about a swivel point so that they assume the desired position. For a precise engagement of the leading edge of the the paper sheets with the front lays, the latter must be precisely aligned with respect to one another. After each adjustment, for example, when individual front lays are thrown in or thrown off in order to effect a change of page size or format, the front lays which are effective for sheet alignment must likewise be precisely re-aligned. In the case of such a front-lay device, a great outlay for high-resolution adjusting means is necessitated. An enormous expense for construction, entailing the provision of many components, is required for each front lay. The positioning or adjusting means are provided with latching positions. These must be coordinated with maximum precision, so that one or the other of the front lays does not deviate even ever so slightly to the front or the rear from the alignment of the front lays, a deviation which would be further magnified by the geometry of the required angular swiveling of the front lay. It is then no longer possible to ensure a precise front-edge alignment. The latching means are subject to settling and wear phenomena, due to which a deterioration in the accuracy of a repetition of the settings occurs. Moreover, an adjustment which is effected with the aid of so many components on the front-lay holder is highly susceptible to fouling, for example, by paper dust, so that the front lays are subject to an increased risk of operational disorders. When in actual operation with a cyclically actuated front-lay shaft, the great moving mass of the components provided on the front-lay shaft creates an increased risk of undesired vibrations, particularly at high speeds.

German Published Non-Prosecuted Application (DE-OS) 40 04 447 discloses a front lay on a front-lay foundation, which is swung cyclically with the front lay into a sheet-engagement position. In the sheet-engagement position, the individual front lays are brought into engagement with stops situated on the feed table, by compression springs which are braced against the front-lay foundations.

For this purpose, the front lay is attached flexibly, for example, by means of a leaf spring, to the front-lay foundation. The stops are connected by a linkage to an otherwise non-disclosed positioning mechanism mounted on the feed table.

In this case, too, the maintenance of precise alignment is a complex operation. The manufacture of the stops must permit precise alignment. Even a slight tilting of the displaceable stops in their guides, for example, due to fouling or wear, may have a negative effect upon the alignment line and, consequently, upon the alignment of the paper sheet. After every adjustment of the stops, for example, when individual front lays have been thrown in or thrown off in order to effect a change in page size or format, it is always necessary to perform new adjustments repeatedly. The rigid front-lay face harbors the risk of a tilting of the front lay due to a possible slight tipping at the bottom edge of the stop if the final position of movement of the front-lay body has been imprecisely set. The large moving mass of the front lay harbors risks of vibration in itself despite damping by the counteracting compression spring.

It is accordingly an object of the invention to provide, at low expense and with minimal complexity, a device for aligning a leading edge of a sheet wherein individual front lays are thrown in and thrown off with a relatively simple alignment of the front lays and with high accuracy of repetition of the alignment.

With the foregoing and other objects in view, there is provided, in accordance with the invention, a device for aligning a leading edge of sheets, comprising a plurality of front lays cyclically movable into an operating position, precisely aligned engagement means engageable by the plurality of front lays, force-storage means for bringing the plurality of front lays into engagement with the engagement means in the operating position of the plurality of front lays, and means, independent of the engagement means, for throwing off individual front lays of the plurality of front lays.

According to this construction, the engagement means are precisely aligned just once prior to start-up. Precise alignment is thus achieved simply without further complication or expense. Due to the throw-in or engagement of the front lays by means of force-storage devices and the separation of the engagement means from the means for throwing off the individual front lays a non-varying alignment is ensured even after frequent use and after frequently performed throw-in and throw-off operations on individual front lays.

In accordance with another feature of the invention, the plurality of front lays are formed of inherently resilient or springy material. This permits the construction to be especially simple and to require few components. The reduced susceptibility to malfunction due to possible fouling results in a reliable throw-in or engagement, even during continuous operation, as well as in low maintenance expense.

In accordance with a further feature of the invention, the front lays are shaped leaf springs. The device for leading-edge alignment is especially simple to manufacture. The use of few components with front lays having a low-vibrating mass permits a front-lay throw-in or engagement which is free from troublesome vibrations.

In accordance with an added feature of the invention, the engagement means comprise a member in common for all of the plurality of front lays. By providing a common engagement member for all of the front lays, the once-only alignment of a plurality of front lays relative to one another can be dispensed with.

In accordance with an additional feature of the invention, the common engagement member is a once-only precisely engineered engagement ruler. This represents an especially simple, preferred construction which is advantageous with respect to manufacturing technology.

In accordance with yet another feature of the invention, the means for throwing off individual front lays comprise throw-off stops, and include means for adjustable positioning the throw-off stops. The means for throwing off the front lays from their operating position are especially simple and reliable constructions.

In accordance with yet further features of the invention, the device includes slides carrying the throw-off stops, the slides being mounted directly adjacent, either above or below, the engagement means and being displaceable relative thereto. The throw-off stops are especially reliable and simple in terms of manufacture and operation.

In accordance with yet an added feature of the invention, the positioning means comprise bolt bodies rotatably mounted in the appertaining engagement means perpendicularly to the sheet-conveying direction, the bolt bodies having, in a partial axial region thereof, a cross section eccentrically formed relative to the respective rotational axis of the bolt bodies, the cross section corresponding to a stop of the appertaining slide, the stop being disposed between a respective bolt body and a respective front lay.

In accordance with yet an additional feature of the invention, the engagement means comprise an engagement ruler common to all of the plurality of front lays, and the positioning means comprise screws threadedly received in the engagement ruler and, respectively, having a conical tip corresponding to conical indentations formed in the slides.

In accordance with another feature of the invention, a screw is screwed into the engagement means, for each of the plurality of front lays, the screw having a stop in an end region thereof and being rotatable for bringing the stop into an active connection with an appertaining front lay of the plurality of front lays.

In accordance with a concomitant aspect of the invention, there are provided, in combination, a sheet feeding table of a sheet-fed printing machine and a device for aligning a leading edge of sheets, comprising a plurality of front lays cyclically movable into an operating position, precisely aligned engagement means engageable by the plurality of front lays, force-storage means for bringing the plurality of front lays into engagement with the engagement means in the operating position of the plurality of front lays, and means, independent of the engagement means, for throwing off individual front lays of the plurality of front lays, the means for throwing off individual front lays being disposed on the sheet feeding table. By providing the throw-off means on the feed table, the front lay is not disturbed in its own motion either by the mass or by the kinematics of the throw-of f means. The throw-off means may be quite simple structurally and functionally, and the constructional outlay required for throwing off may be minimized.

Other features which are considered as characteristic for the invention are set forth in the appended claims.

Although the invention is illustrated and described herein as embodied in a device for aligning a leading edge of a sheet, it is nevertheless not intended to be limited to the details shown, since various modifications and structural changes may be made therein without departing from the spirit of the invention and within the scope and range of equivalents of the claims.

The construction and method of operation of the Invention, however, together with additional objects and advantages thereof will be best understood from the following description of specific embodiments when read in connection with the accompanying drawings, in which:

FIG. 2 is a top plan view of the aligning device of FIG. 1;

Figure 3:
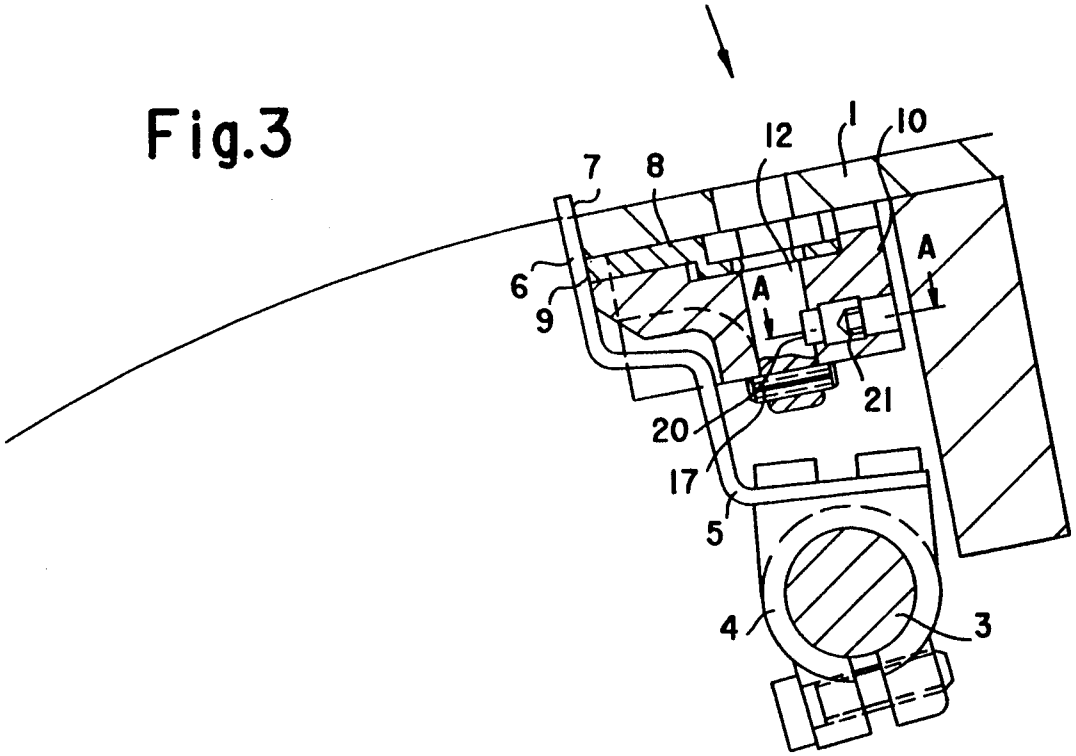
Figure 3A:
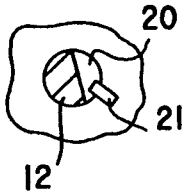
Figure 4A:
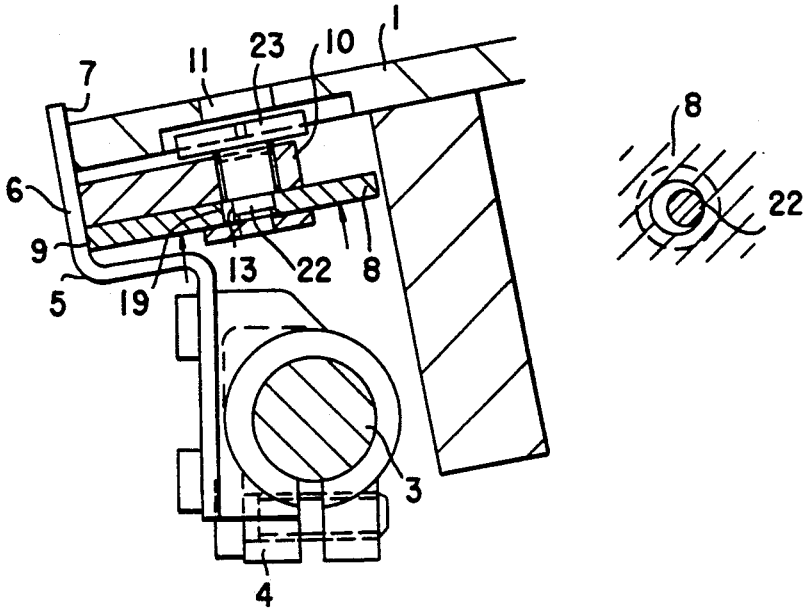
Figure 4B:
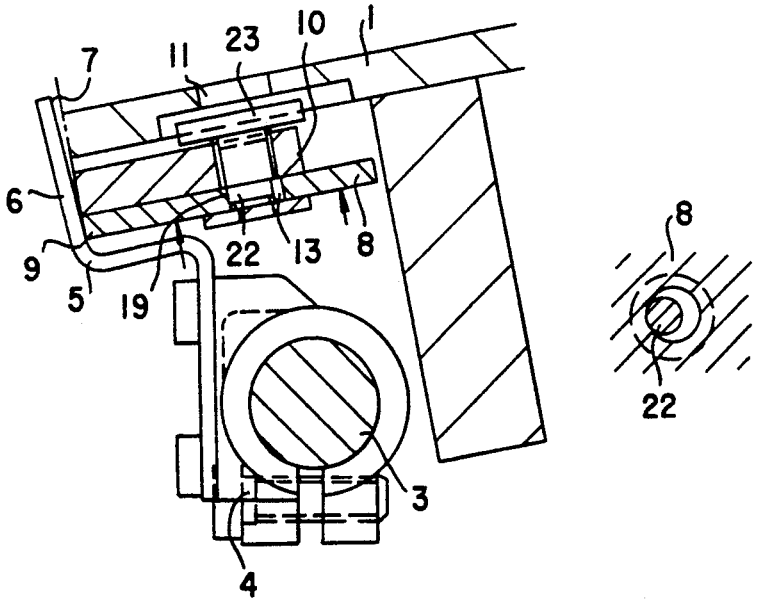
Figure 5A:
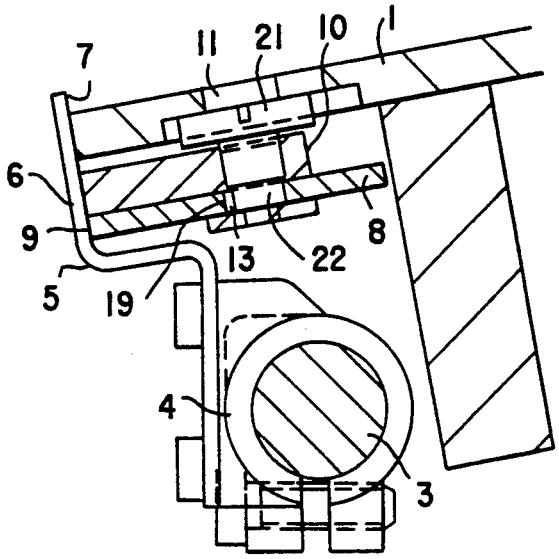
Figure 5B:
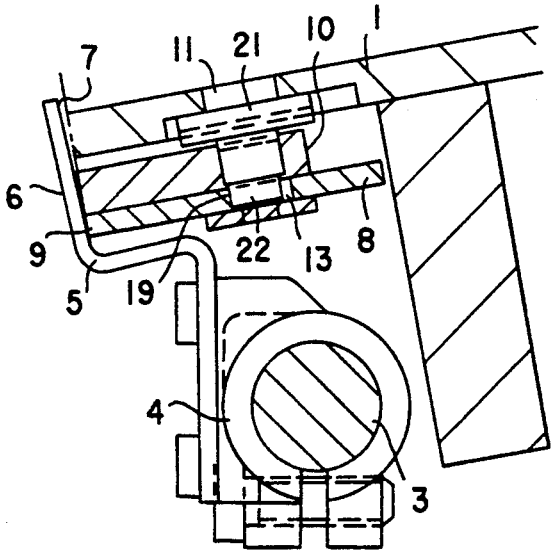
Figure 6:
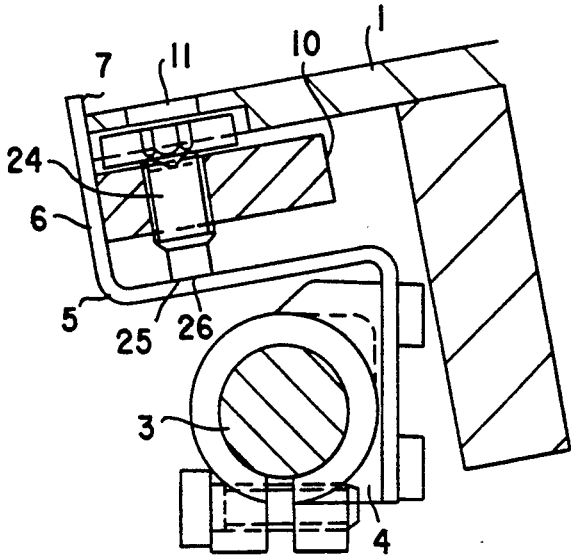
Figure 7:
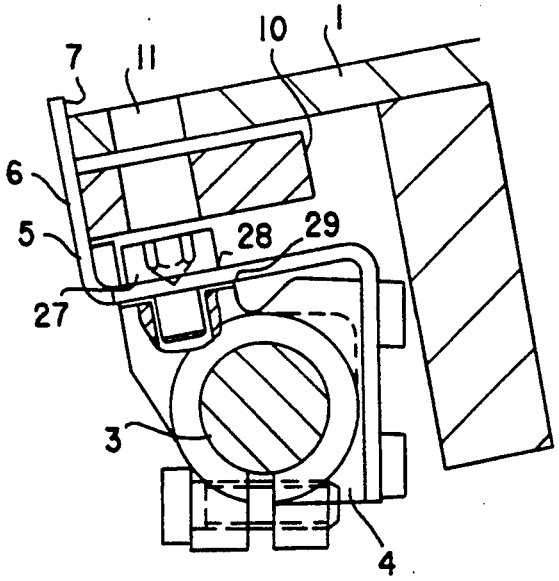
Figure 8:
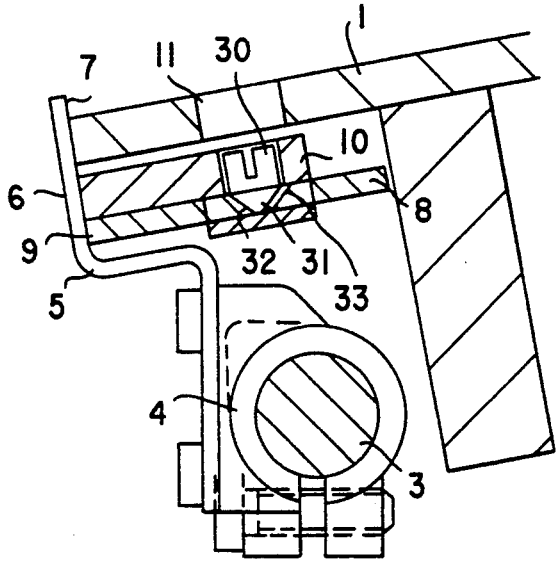
Figure 9:
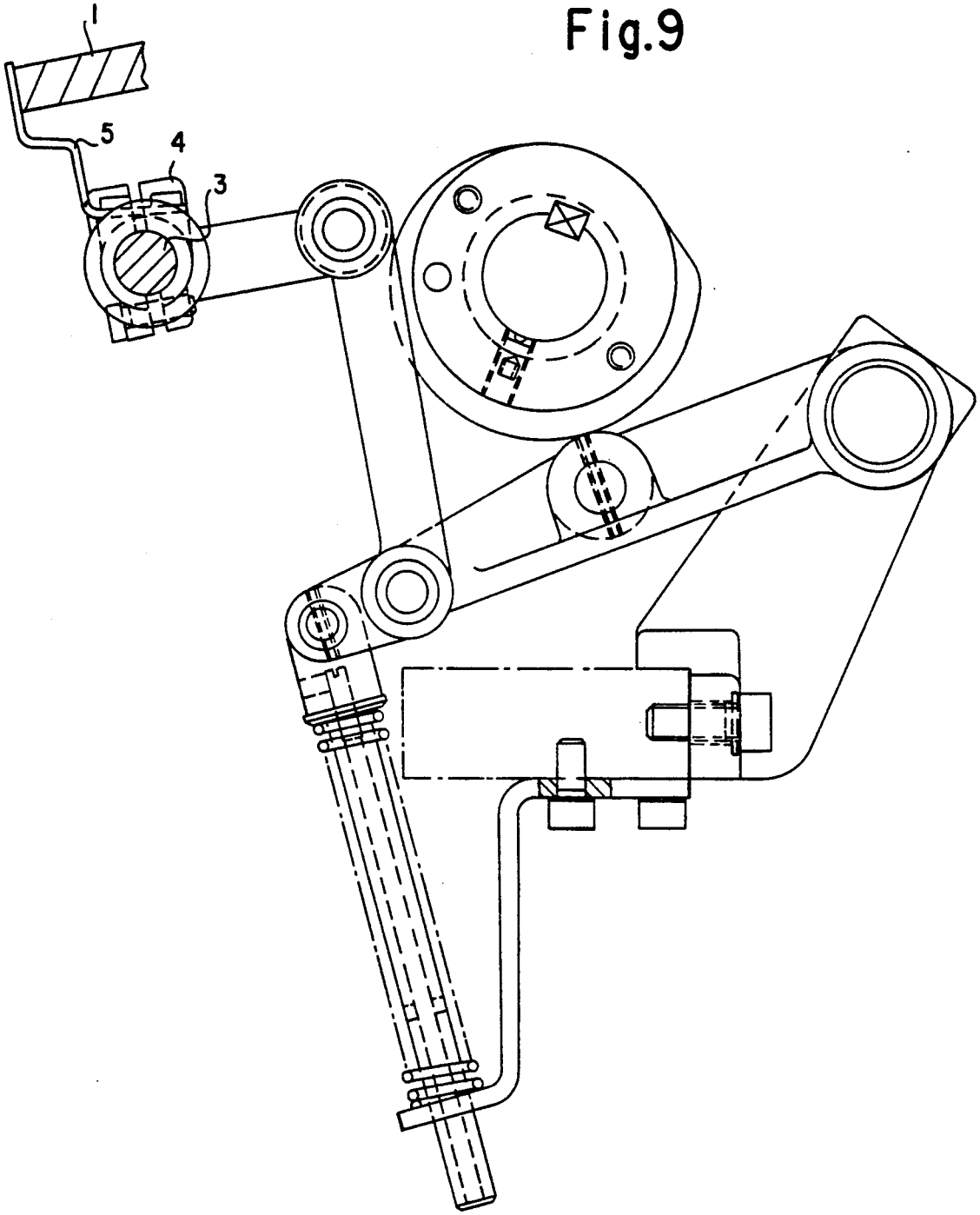

FIG. 2*a* is a sectional view of FIG. 2 taken along the line I—I in the direction of the arrows;

FIG. 2*b* is a sectional view of FIG. 2 taken along the line II—II in the direction of the arrows;

FIG. 3 is a cross-sectional view of a second embodiment of the device with a slider;

FIG. 3*a* is a cross-sectional view of FIG. 3 taken along the line III—III in the direction of the arrows;

FIGS. 4*a* and 4*b* are views like that of FIG. 3 of a third embodiment of the invention, wherein FIG. 4*a* includes a front lay in aligned position, and FIG. 4*b* includes the front lay in a turned-off position;

FIGS. 4*a'* and 4*b'* are cross-sectional views, respectively, of FIGS. 4*a* and 4*b* taken along the respective lines X—X and Y—Y in the direction of the arrows;

FIGS. 5*a* and 5*b* are views like that of FIG. 3 of a fourth embodiment of the invention with a slider and wherein FIG. 5*a* includes a front lay in aligned position, and FIG. 5*b* includes a front lay in turned-off position;

FIG. 6 is a view like that of FIG. 3 of a fifth embodiment of the invention with a screw-type turn-off;

FIG. 7 is a view like that of FIG. 3 of a sixth embodiment of the invention with a screw-type turn-off;

FIG. 8 is a view like that of FIG. 3 of a seventh embodiment of the invention with a slider;

FIG. 9 is a side elevational view of an exemplary front-lay drive.

Figure 1:
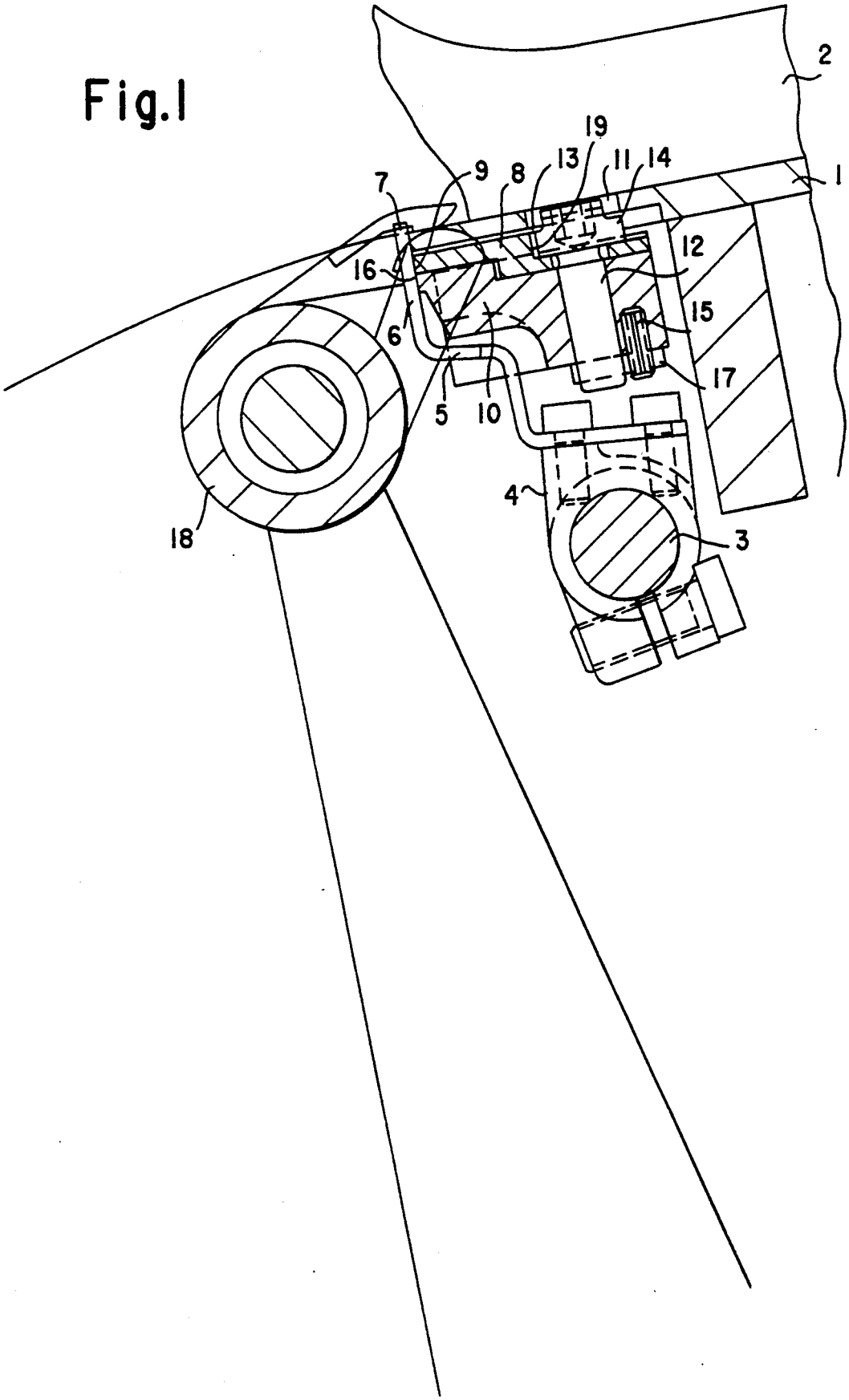
FIG. 1 is a cross-sectional view of the device for aligning a leading edge of a sheet according to the invention assembled with a pregripper and a sheet feeder table.

Referring now to the drawings and, first, particularly to FIG. 1 thereof, there is shown therein a feed table 1 of a sheet-fed offset printing press, non-illustrated paper sheets being conveyed across the feed table 1 from the right-hand side of FIG. 1 by likewise non-illustrated conveying means to a front lay 5. The paper sheets are aligned by the leading edges thereof at sheet-engagement edges 7 of the front lays 5, the sheet-engagement edges 7, for this purpose, penetrating the surf ace of the feed table 1. Pregrippers 18 then convey the paper sheets farther to the printing units of a sheet-fed printing press for printing thereon.

The front lay 5 is attached to a clamping part 4 which, in turn, is clamped firmly to a front-lay shaft 3. The front-lay shaft 3 is aligned transversely to a sheet-conveying direction from the right-hand to the left-hand side of FIG. 1 and is rotatably held below the table top 1 in two side frame parts 2, only one of which is shown. The front-lay shaft 3 is provided with driving means, as shown by way of example in FIG. 9, for cyclically swinging the front lay up and down.

As shown in FIGS. 1 and 2, an engagement ruler 10, which is disposed transversely to the sheet-conveying direction and is mounted in the side frame parts 2, is provided below the top of the feed table 1 at a location forward of the front lay 5 in the sheet-conveying direction. A side of the engagement ruler 10 facing towards the front lay is formed with a ruler stop face 16. The ruler stop face 16 is precisely reworked in a single operation.

In the operating position of the front lay 5, an engagement region 6 thereof is thrown in or brought by the driving means for the front-lay shaft 3, under a preload, cyclically into engagement with the ruler stop face 16 of the engagement ruler 10. The front lay 5 is formed of an upwardly bent leaf spring, preferably with a flat spring characteristic, due to which, when compensating for manufacturing tolerances, there is a lesser difference in the preload forces. By swiveling the front-lay shaft 3 in the opposite direction, the front lays 5 are swung cyclically out of the thrown in or engagement position thereof, wherein the sheet-engagement edges 7 thereof are above the feed table 1, into a position thereof wherein the sheet-engagement edges 7 are below the feed table 1.

In order to remove individual front lays 5 from the working position thereof, a respective slide 8, which is displaceable in the sheet-conveying direction and disposed upstream of each front lay 5, is located in a bottom part of the table top 1 above the engagement ruler 10. The slide 8 is provided with a slide-stop face 9 facing towards the front lay 5.

In order to disable one of the front lays 5 from being effective in the sheet-aligning operation, the slide 8 associated therewith is pushed in the sheet-conveying direction towards the left-hand side of the figure so that a slide-stop face 9 thereof extends slightly beyond the ruler-stop face 16. When the respective front lay 5 is swiveled up towards the operating position thereof for effecting sheet alignment, it strikes against the respective slide-stop face 9 and not against the respective ruler-stop face 16. This front lay 5, therefore, does not come into contact with the paper sheet which is to be aligned. To enable this front lay 5 to be effective again, the slide 8 is pushed back so far towards the right-hand side of FIG. 1 that the slide-stop face 9 retreats in the sheet-conveying direction behind the ruler-stop face 16. The next time the front lays 5 are swiveled upwardly towards the operating position thereof, the engagement region 6 of the respective front lay 5 then again strikes the ruler-stop face 16, and the respective front lay 5 assumes a precisely aligned engagement position for sheet alignment.

In the illustrative embodiment shown in FIG. 1, a positioning bolt 12 is rotatably mounted in a through-bore formed in the engagement ruler 10. The positioning bolt 12 also passes with play through a through-bore formed in the slide 8 and disposed concentrically or coaxially with the through-bore of the engagement ruler 10. Above the slide 8, the positioning bolt 12 is provided with a bolt head 14 disposed in the through-bore formed in the engagement ruler 10 eccentrically to the rotational axis of the positioning bolt 12, and preventing the positioning bolt 12 from sliding through the respective through-bores formed in the slide 8 and the engagement ruler 10. Below the engagement ruler 10, the positioning bolt 12 is secured by a transverse bolt 17 against being pulled out. Downstream from the eccentric bolt head 14, as viewed in the sheet-conveying direction, the slide 8 is provided with a stop face 19 for the eccentric head 14, the stop face 19 extending parallel to the axis of the positioning bolt 12. The bolt head 14 is provided with an inner profile for accepting an inner hexagon-socket wrench.

With the aid of the inner hexagon-socket wrench, it is possible to rotate the positioning bolt so as to vary the angular position thereof, for example, by means of an oblong hole 11 formed in the feed table 1. In order to disable a respective front lay 5, the positioning bolt 12 is turned so that a region of the eccentric bolt head 14 thereof having a larger radius extending from the axis of the positioning bolt 12, is directed towards the stop face 19 of the slide 8. The slide 8 is thereby displaced in the sheet-conveying direction. Conversely, if the eccentric bolt head 14 is turned so that its region of smaller radius extends from the rotational axis of the positioning bolt 12 in the direction towards the stop face 19, a play or clearance 13 is formed between the bolt head 14 and the stop face 19. The instant the front lay 5 swings into the operating position thereof, in the course of the operating cycle, the front lay 5 pushes the slide 8 back and itself strikes the ruler-stop face 16 of the engagement ruler 10. The positioning bolt 12 has a positioning range which is limited by two pins 15 which are fastened to the underside of the engagement ruler 10 and serve as stops for the transverse bolt 17. Of course, the bolt head 14 should not be of such dimensions as to penetrate the surface of the feed table 1. It is also conceivable that restoring means, such as a spring, for example, be used additionally to reinforce the return of the front lay 5 to its position.

In the exemplary embodiment shown in FIGS. 1 and 2, the front lay 5 has a fork-shaped construction with front-lay fingers 5*a* and 5*b* in a forward region thereof, so that pregrippers 18 are able to penetrate the fork opening between the fingers 5*a* and 5*b*. Correspondingly, the slide 8 and the engagement ruler 10 are also provided with recesses or cutouts for the pregrippers 18. Accordingly, the slide-stop face 9 is formed with two slide-stop faces 9*a* and 9*b* which correspond to the front-lay fingers 5*a* and 5*b*.

In the cross-sectional view of FIG. 2*a* taken along the line A—A in FIG. 2, the slide 8 is shown with the front lay 5 thereof disabled or thrown off, whereas, in the cross-sectional view of FIG. 2*b* taken along the line B—B in FIG. 2, the slide 8 is shown with the front lay 5 thrown in or engaged.

A further possibility for limiting the positioning angle of the positioning bolt 12 is shown in FIG. 3. The positioning bolt 12 is formed with a groove 20 disposed over a limited angular range in a plane perpendicular to the rotational axis of the positioning bolt 12 in the region wherein the the through-bore is formed in the engagement ruler 10. The groove 20 is penetrated by a positioning screw 21, which is screwed into a another through-bore which is formed with a female thread in the engagement ruler 10, the female thread corresponding to the male thread formed on the positioning screw 21, the latter through-bore being aligned perpendicularly to the rotational axis of the positioning bolt 12 and communicating with or terminating in the through-bore for the positioning bolt 12. The positioning range of the positioning bolt 12, in this case, is limited by the adjustment depth of the limiting positioning screw 21 and by the depth of the groove 20.

In this example, it is also possible for the transverse bolt 17 to be replaced by a limiting disk or washer.

In FIGS. 4*a*, 4*a'*, 4*b* and 4*b'*, on the one hand, and FIGS. 5*a* and 5*b*, on the other hand, additional embodiments of the invention are shown wherein the slide 8 is displaceably held in the engagement ruler 10 below the sheet-engagement edge 7.

In the embodiment of FIGS. 5*a* and 5*b*, for the purpose of adjustment, a positioning bolt 21 is rotatably mounted in a through-bore formed in the engagement ruler 10. In order to adjust the slide 8, a stud of the positioning bolt 21 penetrates into a through-bore formed in the slide 8. The penetrating stud of the positioning bolt 21 has a cross section which is eccentric to the rotational axis of the positioning bolt disposed in the through-bore formed in the engagement ruler 10. In this case also, it is possible to rotate the positioning bolt 21, in the position thereof, with the aid of a tool which penetrates a through-bore formed in the feed table. It is thereby possible to alter the radii of the eccentric cross section 22 which are directed from the rotational axis of the positioning bolt 12 towards the stop face 19 of the slide 8 in the through-bore. If the radius is increased, the slide 8 is pushed towards the front lay 5, as shown in FIG. 5*b*. If this radius is reduced, the slide 8 can be pushed back again by the front lay 5.

In the embodiment of FIGS. 4*a*, 4*a'*, 4*b* and 4*b'*, the positioning bolt 21 is replaced by a screw 22 formed with a thread corresponding to a female thread provided in the inner bore of the engagement ruler 10.

FIGS. 6 and 7 illustrate further embodiments of the invention which have no slides.

In the embodiment of FIG. 6, a positioning screw 24 with a stud is provided for each front lay 5, the positioning screw 24 penetrating the engagement ruler 10 in through-bores provided with female or internal threads. The positioning screw 24 being formed with a male or external thread corresponding with the female thread of the through-bore.

The stud of the positioning screw 24 has an end face 25 serving as a stop face which corresponds with a stop face 26 of the front lay 5. Using a simple tool, for example a hexagon-socket wrench, which is inserted through the through-opening in the feed table in order to operate the positioning screw 24, it is possible to move the screw 24 axially with its stop face 25 against the stop face 26 of the front lay 5, whereby the front lay 5, with its sheet-engagement edge 7, can be thrown off from its operating position and thus be out of engagement with the sheet or, if the positioning screw 24 is screwed back, can be thrown in again and brought into engagement with the sheet.

FIG. 7 shows yet another embodiment of the invention wherein a positioning screw 27 is screwed through a through-opening in the front lay 5 into a blind hole formed with a female or internal thread in the clamping part 4. With the front lay 5 thrown in or engaged, there is play 28 between the head of the screw 27 and the front lay 5 as well as between the front lay 5 and the clamping part 4. The positioning screw 24 can be actuated with the aid of a tool through through-openings 11 formed in the feed table 1 and in the engagement ruler 10. When the screw 24 is screwed in, the play 28 between the screw head and the front lay 5 is overcome, so that the front lay 5 is disabled or thrown off from its operating position until, at most, play 29 between the front lay 5 and the clamping part 4 is overcome. In this case, disabled or thrown off front lays do not generate any torque in the front-lay shaft.

In the embodiment of the invention shown in FIG. 8, a positioning screw 30 with a conical tip 31 is screwed into the female thread of a through-bore formed in the engagement ruler 10. Once again, for each front lay 5, a slide 8 with a slide-stop face 9 is supported in the engagement ruler 10 in such a manner as to be displaceable in the sheet-conveying direction. The slide 8 is provided with a conical indentation or depression 32 having an aperture angle which corresponds to that of the tip 31 of the positioning screw 30. The maximum diameter of the indentation 32 is greater than the maximum diameter of the tip 31 which penetrates into it. If the positioning screw 30 is screwed in with the aid of a tool which is introduced through a through-opening 11 formed in the feed table, contact is made between the front generatrix of the conical tip 31 and the front generatrix of the indentation 32 in the slide 8. As the positioning screw 30 is turned farther, the front generatrix of the indentation 32 slides forward along the front generatrix of the conical tip 31, as a result of which the slide 8 is reduced, with a reduction in the play 33 between a rear generatrix of the conical tip 31 and a rear generatrix of the indentation 32. The slide 8 is pushed, with its slide-top face 9, in the sheet-conveying direction beyond the front-lay line of the engagement ruler 10, as a result of which, when the front lays 5 are swung up into the operating position thereof, the respective front lay 5 is in a disabled or thrown off position in contact with the slide-stop face 9. If the positioning screw 30 is then re-engaged, play is created between the front generatrix of the positioning tip 31 and the front generatrix of the indentation 32. In the next cycle, when the respective front lay 5 strikes the slide-stop face 9 of the slide 8, the latter is pushed back behind the engagement line of the engagement ruler 10 by the spring force of the front lay 5.

The foregoing is a description corresponding in substance to German Application P 41 34 767.6, dated Oct. 22, 1991, the International priority of which is being claimed for the instant application, and which is hereby made part of this application. Any material discrepancies between the foregoing specification and the aforementioned corresponding German application are to be resolved in favor of the latter.

What is claimed is:

1. Device for aligning a leading edge of sheets, comprising a plurality of front lays cyclically movable into an operating position, aligned engagement means formed on a single stationary member and being engageable in common by said plurality of front lays in said operating position thereof, force-storage means for bringing said plurality of front lays into engagement with said engagement means in said operating position of said plurality of front lays, and means, independent of said engagement means, for disabling individual front lays of said plurality of front lays from engagement with said aligned engagement means.

2. Device according to claim 1, wherein said plurality of front lays are formed of inherently resilient material.

3. Device according to claim 2, wherein said front lays are shaped leaf springs.

4. Device according to claim 1, wherein said stationary member is an engagement ruler.

5. Device according to claim 1, wherein said means for disabling said individual front lays comprise stops, and the device includes means for adjustably positioning said stops.

6. Device according to claim 5, including slides carrying said stops, said slides being mounted directly adjacent said engagement means and being displaceable relative thereto.

7. Device according to claim 6, wherein said slides are mounted directly above said engagement means.

8. Device according to claim 6, wherein said slides are mounted directly below said engagement means.

9. Device according to claim 6, wherein said positioning means comprise bolt bodies rotatably mounted in the appertaining engagement means perpendicularly to sheet-conveying direction, said bolt bodies having, in a partial axial region thereof, a cross section eccentrically formed relative to the respective rotational axis of said bolt bodies, said cross section corresponding to a stop of the appertaining slide, said stop being disposed between a respective bolt body and a respective front lay.

10. Device according to claim 6, wherein said engagement means comprise an engagement ruler common to all of said plurality of front lays, and said positioning means comprise screws threadedly received in said engagement ruler and, respectively, having a conical tip corresponding to conical indentations formed in said slides.

11. Device according to claim 5, wherein a screw is screwed into said engagement means, for each of said plurality of front lays, said screw having a stop in an end region thereof and being rotatable for bringing said stop into an active connection with an appertaining front lay of said plurality of front lays.

12. In combination, a sheet feeding table of a sheet-fed printing machine and a device for aligning a leading edge of sheets, comprising a plurality of front lays cyclically movable into an operating position, aligned engagement means formed on a single stationary member and being engageable in common by said plurality of front lays, in said operating position thereof, force-storage means for bringing said plurality of front lays into engagement with said engagement means in said operating position of said plurality of front lays, and means, independent of said engagement means, for disabling individual front lays of plurality of front lays, said means for disabling individual front lays being disposed on the sheet feeding table from engagement with said aligned engagement means.

* * * * *